US005368079A

United States Patent [19]

Benway

[11] Patent Number: 5,368,079

[45] Date of Patent: Nov. 29, 1994

[54] ADJUSTABLE DADO

[76] Inventor: Randy E. Benway, 810 Rice St., Horicon, Wis. 53032

[21] Appl. No.: 182,533

[22] Filed: Jan. 18, 1994

Related U.S. Application Data

[63] Continuation-in-part of Ser. No. 90,345, Jul. 9, 1993, abandoned.

[51] Int. Cl.[5] ..... B27G 13/00

[52] U.S. Cl. ..... 144/237; 144/218; 144/238; 407/48; 407/60

[58] Field of Search ..... 407/40, 41, 48, 60; 144/218, 237, 238

[56] References Cited

U.S. PATENT DOCUMENTS 2,788,812 4/1957 Jacobs ..... 144/237

FOREIGN PATENT DOCUMENTS 1040453 10/1953 France ..... 144/238
1321208 11/1963 France ..... 144/238

*Primary Examiner*—W. Donald Bray
*Attorney, Agent, or Firm*—Wheeler & Kromholz

[57] ABSTRACT

An adjustable dado having the adjustment ease of a wobble type dado with the cut quality of a stacking type dado. The outer cutting blade is bored and threaded, and a threaded adjusting collar is threaded into the outer blade. An adjustment washer has pins to engage openings in the adjusting collar, so that rotation of the adjustment washer adjusts the position of the outer blade. The invention allows quick and easy adjustment of a stacking dado without removal of the dado blades.

18 Claims, 5 Drawing Sheets

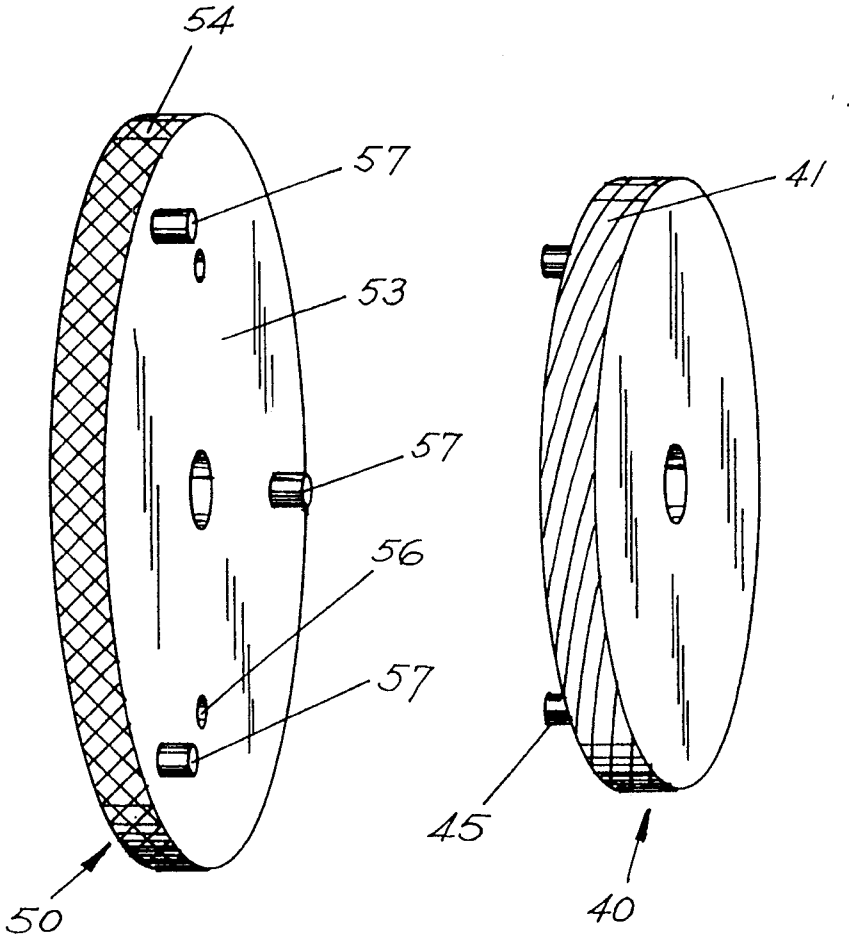
FIG. 13
FIG. 12
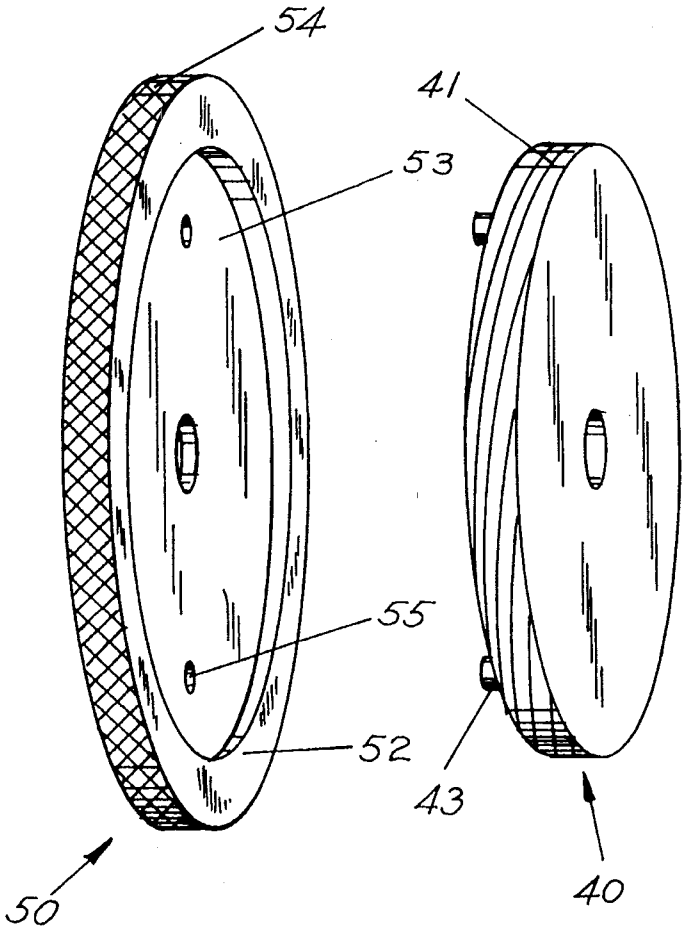
FIG. 11
FIG. 10

ADJUSTABLE DADO

This application is a continuation-in-part of application Ser. No. 08/090,345 filed 9 Jul. 1993, now abandoned.

BACKGROUND OF THE INVENTION

The present invention relates to the field of adjustable saw blades. More particularly, it relates to adjustable dado blades for cutting grooves or slots into wood.

Many devices are currently made for cutting grooves or slots, called dados, in wood. The devices fall into two general categories, wobble dados and stacking dados. The wobble dado generally contains a single blade mounted at an adjustable angle. The tilted blade cuts a channel into a piece of wood and appears to wobble as it spins. Some new wobble dados contain two blades in a V-shape. They are called V-wobble dados, and use the same principle as single blade wobble dados, but with two blades cutting instead of one.

Stacking dados generally contain two outer cutters, and a set of chippers to be mounted between the outer cutters. Depending on the width of the groove desired a different number of chippers are placed on the saw arbor between the outer blades. Adjustment of the wobble type of dado blade is fairly simple. Because of the tilt of the wobble blade, dados cut with wobble type dado blades are rounded at the bottom of the groove. Additionally, the cut quality is generally not very good. With stacking dados, the groove is normally flat at the bottom and the cut quality is high. However, the price paid for the flat, well cut grooves of stacking dado blades is difficulty in adjustment of groove width. The standard way to adjust groove width is by insertion of ⅛ inch or 1/16 inch chippers between the two main blades. Dado sets typically come with four to five chippers, one of which is 1/16 inch. This configuration allows for adjustment of groove width in 1/16 inch increments. In the past, fine adjustment of groove width has been made using metal, paper or plastic shims placed between one or more of the chippers and outer blades of the stacking dado. This adjustment procedure requires removal of at least the outer cutting blade and insertion of one or more shims to create a desired groove width. Saw set overlap maintains full width of cut between shimmed blades. The process is time consuming and inaccurate, often requiring multiple readjustments. More recently, some plastic shims have been marketed with a slot allowing the user to insert the shims on a saw arbor without removing the blades. However, these types of plastic shims do not work well because the spacing between saw blades is too small to properly insert and remove shims without removing the blades.

The objective of the present invention is to maintain the high quality cut of the stacking dado system, yet to allow the ease of adjustment of the wobble type dado system. The present invention provides a system capable of quick and easy fine adjustment of groove width without removal of the outer blade in a stacking dado system. Additionally, the present invention allows infinite adjustment of the groove width, limited only by the length of the saw arbor.

Other adjustable cutting blades exist in the prior art. For example, U.S. Pat. No. 2,788,812 (Jacobs) discloses an adjustable dado cutter having three blades. The blades move along their axis of rotation in response to rotation of an adjusting sleeve. However, Jacobs requires three blades, an arbor threaded with two different pitch threads that are opposite handed, and allow for proportional movement of the two movable saw blades in a 2:1 ratio. Jacobs does not disclose the simple construction of the present invention, nor does it allow for an infinite range of adjustment limited only to the length of the saw arbor. Additionally, the Jacobs device is not readily adaptable to existing dado cutting sets, nor does it allow for easy conversion from left hand to right hand arbor configurations. The present invention solves the problems encountered in the prior art, while simplifying the structure and performing more functions.

SUMMARY OF THE INVENTION

The present invention is an adjustable dado with the cut quality of a stacking dado blade system, but the adjustment ease of a wobble dado blade. The outer blade of a stacking dado set is bored centrally, with inner threads chased on a lathe by a single point tool. An adjusting collar is threaded with outer threads. The outer blade threads onto the adjusting collar, which fits onto a saw arbor. Then, an adjustment washer fits over the arbor. The adjustment washer has adjusting pins that engage openings in the adjusting collar. Rotation of the adjustment washer results in rotation of the adjusting collar when the adjusting pins are engaged in the openings. This in turn rotates the adjusting collar, and adjusts the position of the outer blade quickly and easily. Total adjustment from the original position of the blade is up to 1/16 of an inch. When the adjustment washer has been adjusted to its desired position, the saw arbor nut is tightened onto the washer.

In an alternative embodiment of the present invention, the adjustment washer has a plurality of openings while the adjusting collar has a plurality of pins. The pins in the adjusting collar engage the openings in the adjustment washer. Again, rotation of the adjustment washer results in rotation of the adjusting collar when the adjustment pins are engaged in the openings. This in turn rotates the adjusting collar, and adjusts the position of the outer blade quickly and easily.

In another alternative embodiment, the adjustment pins and openings are replaced with adjustment tabs and slots. With this embodiment the adjustment tabs may be attached to the adjustment washer while the slots are formed in the adjusting collar similar to the structure of the first embodiment or the adjustment tabs may be attached to the adjusting collar and the slots created in the adjustment washer similar to the alternative embodiment disclosed above.

One advantage of the current invention is that it allows quick and easy fine adjustment of a stacking dado set without removing the blades and chippers from the saw arbor. This results in shorter set up times and quicker adjustment than typical stacking dado sets. The high quality cut of a stacking dado set remains. Another advantage of the present invention is that it is adaptable to both right hand and left hand arbor configurations. Conversion from right hand to left hand machines is as easy as placing the adjustment washer on the other side of the blade. Still another advantage of the present invention is that it allows an adjustable cut width limited only by saw arbor length.

DESCRIPTION OF THE DRAWINGS

FIG. 10 is a perspective view of the first alternative embodiment of the adjustment washer.

FIG. 11 is a perspective view of the first alternative embodiment of the adjusting collar.

FIG. 12 is a perspective view of the second alternative embodiment of the adjustment washer.

FIG. 13 is a perspective view of the second alternative embodiment of the adjusting collar.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 7:
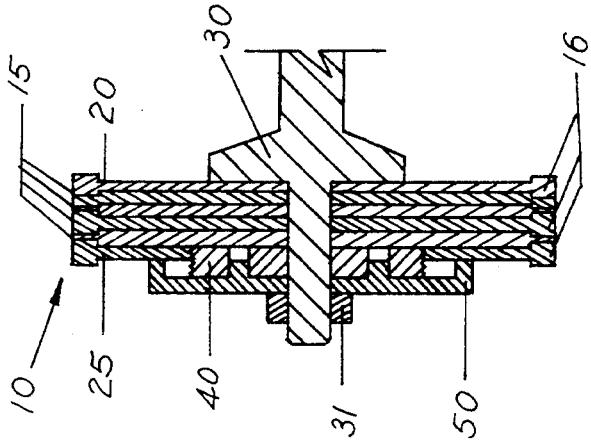
FIG. 7 is a sectional view of the invention in place on a saw arbor.
Figure 2:
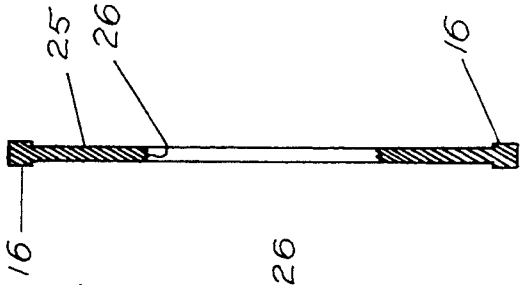
FIG. 2 is a sectional side view of the outer blade.
Figure 1:
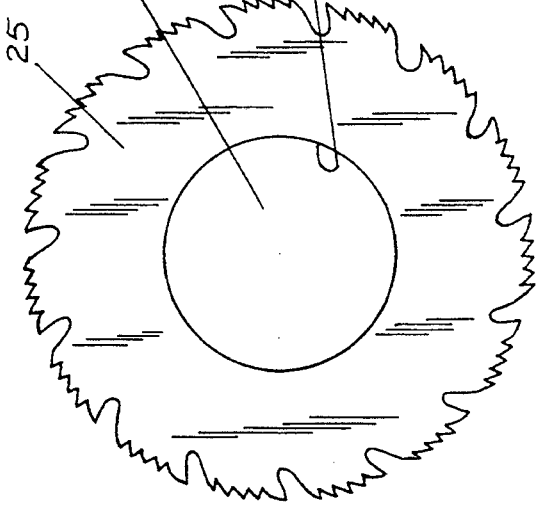
FIG. 1 is a view along the axis of rotation of the outer blade.

Referring to FIG. 7, the adjustable dado 10 may be seen in place on a saw arbor 30. Referring to FIGS. 1 and 2 outer blade 25 may be seen. Outer blade 25 has an opening 27 that is threaded with inner threads 26. Preferably, inner threads 26 are threaded to 24 threads per inch. This provides a 1/24 inch (0.0417 inch) travel per revolution. Accordingly, fine control of the adjustment is maintained.

Figure 4:
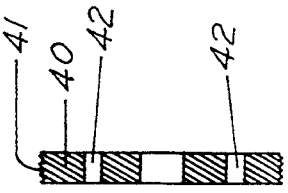
FIG. 4 is a sectional side view of the adjusting collar.
Figure 3:
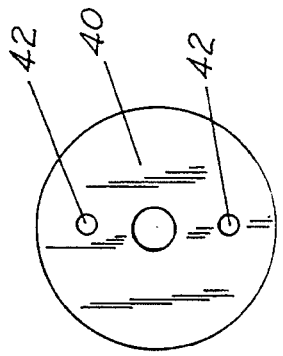
FIG. 3 is a view along the axis of rotation of the adjusting collar.
Figure 6B:
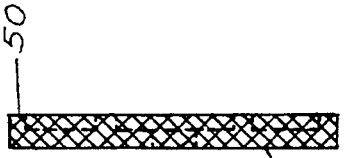
FIG. 6*b* is a side view of the adjustment washer.
Figure 6A:
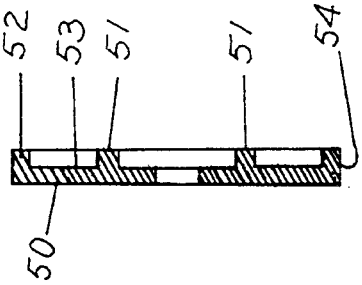
FIG. 6*a* is a sectional side view of the adjustment washer.
Figure 5:
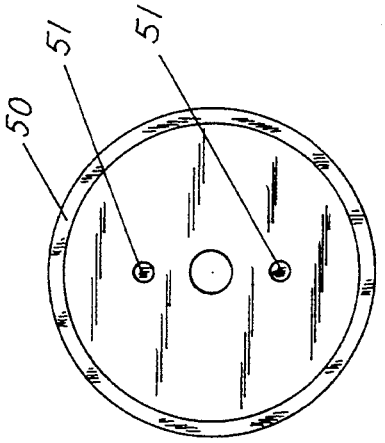
FIG. 5 is a front view of the adjustment washer.
Figure 8:
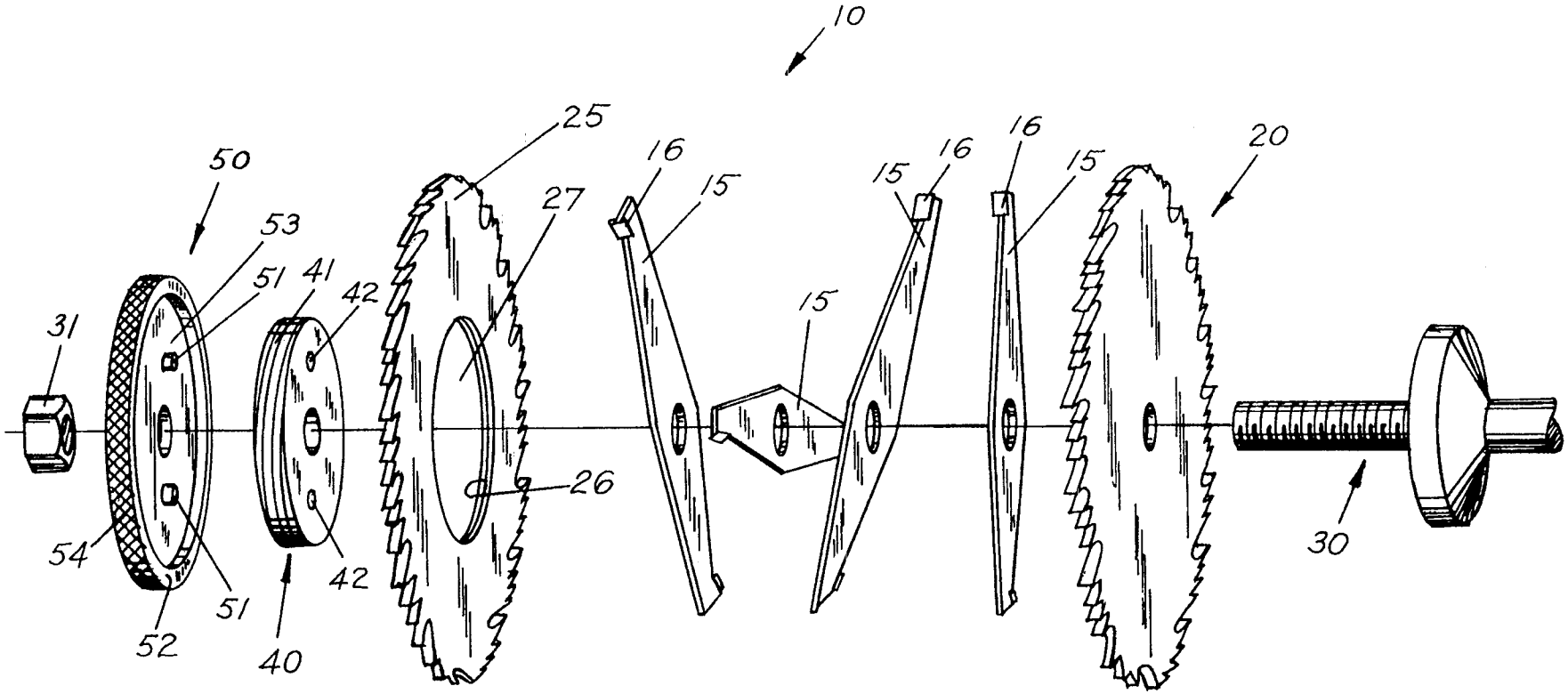
FIG. 8 is an exploded perspective view of the invention.

Referring to FIGS. 3 and 4, the adjusting collar 40 may be seen. Adjusting collar 40 has outer threads 41 threaded to the same thread pitch as inner threads 26, so that adjusting collar 40 may be threaded into outer blade 25. Adjusting collar 40 has a plurality of cylindrical openings 42. Cylindrical openings 42 are designed to engage adjustment pins 51 of an adjustment washer 50. As may be seen from FIGS. 5 and 6, adjustment washer 50 has, in addition to adjustment pins 51, a raised ring 52 that extends from and is integral to front surface 53. The ring 52 extends around the circumference of adjustment washer 50.

The invention functions as follows: After placement on the saw arbor 30 of the inner blade 20 and the desired number of chippers 15, the outer blade 25 is threaded with adjusting collar 40 and placed onto arbor 30. Adjustment washer 50 is placed onto arbor 30 so that adjustment washer 50 and adjustment pins 51 engage adjustment pin openings 42 on adjusting collar 40. Rotation of adjustment washer 50 therefore adjusts position of outer blade 25 due to the threaded engagement of adjustment pins 51 with adjustment pin openings 42 on the adjusting collar 40. When the outer blade 25 has been adjusted to the desired position, arbor nut 31 is placed onto arbor 30 and tightened so that the adjustable dado 10 will not slip during cutting. Due to saw blade overlaps 16, this groove width adjustment will not adversely affect the full width of cut.

Figure 9:
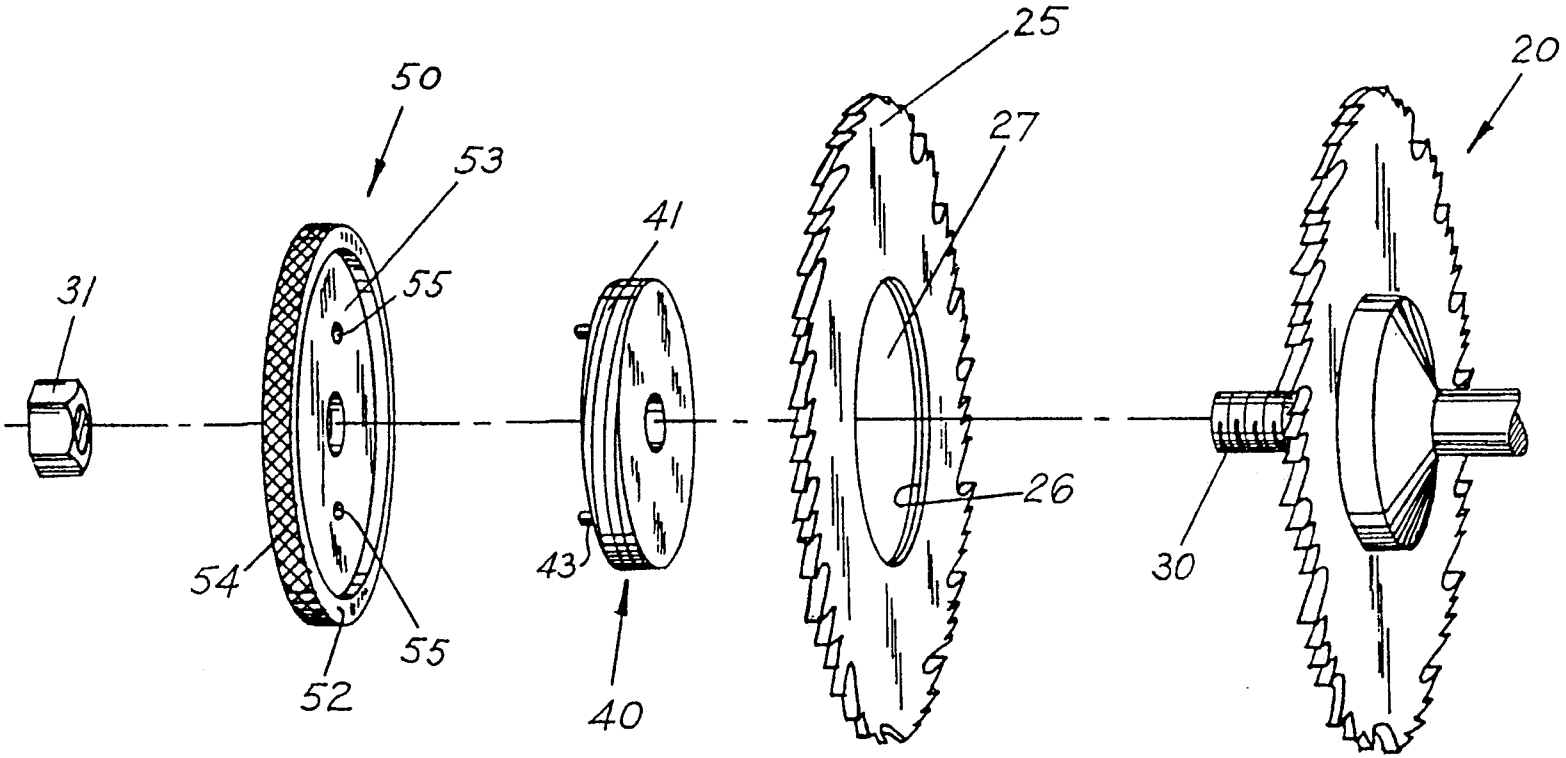
FIG. 9 is an exploded perspective view of a first alternative embodiment of the invention.

A first alternative embodiment of the present invention is shown in FIGS. 9, 10, and 11. As can be seen in FIGS. 9 and 10, adjustment pins 51 have been replaced with openings 55 in front surface 53 of adjustment washer 50. Similarly referring to FIGS. 9 and 11, openings 42 have been replaced with adjustment pins 43. As in the preferred embodiment, adjustment washer 50 is placed onto arbor 30 so that openings 55 in adjustment washer 50 receive adjustment pins 43 in adjusting collar 40. Rotation of adjustment washer 50 again adjusts the position of outer blade 25 due to the threaded engagement on the adjusting collar 40. Such rotation is facilitated by the inclusion of knurled edge 54 on adjustment washer 50. When the outer blade 25 has been adjusted to the desired position, arbor nut 31 is again placed onto arbor 30 and tightened so that the adjustable dado 10 will not slip during cutting.

A second alternative embodiment is shown in FIGS. 12 and 13. As in the first alternative embodiment, adjustment pins 51 on adjustment washer 50 on the preferred embodiment have been replaced with openings 56. Similarly, openings 42 on adjusting collar 40 have been replaced with adjustment pins 45. In addition, raised ring 52 that extended from and was integral to front surface 53 of adjustment washer 50 in the preferred embodiment has been replaced with 3 legs 57. Instead of circumferential raised annular ring 52 contacting outer blade 25 as in the preferred embodiment, legs 57 now make 3-point contact with outer blade 25.

Figure 15:
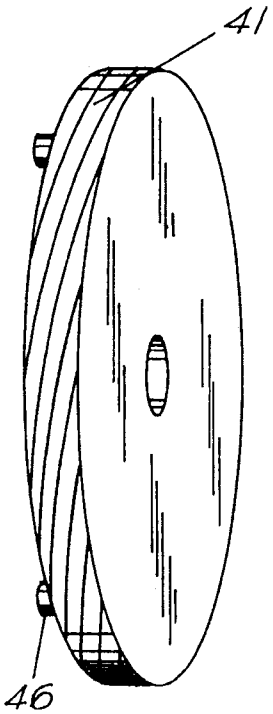
FIG. 15 is a perspective view of the third alternative embodiment of the adjusting collar.
Figure 14:
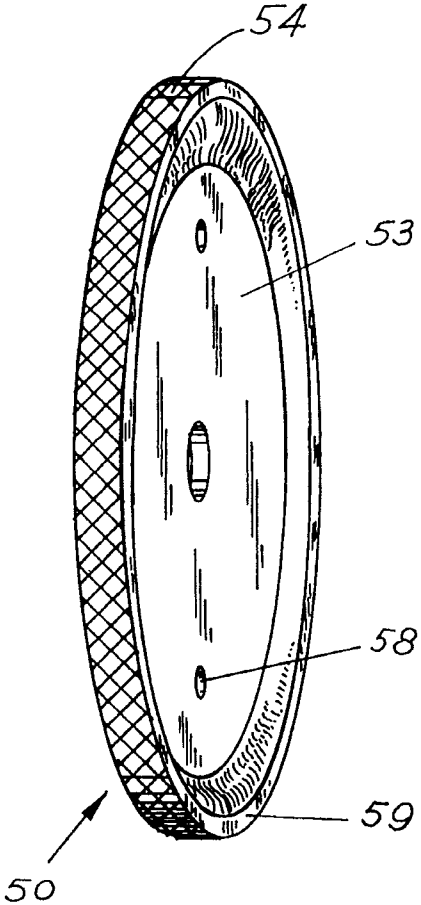
FIG. 14 is a perspective view of the third alternative embodiment of the adjustment washer.

The third alternative embodiment is shown in FIGS. 14 and 15. Again in this embodiment, openings 58 are located on adjustment washer 50 and adjustment pins 46 are attached to adjusting collar 40. As can be seen in FIG. 14, raised circumferential annular ring 52 has been modified. The ring 52 has been replaced with a flared or stamped flange 59. The function of flange 59 is identical to raised ring 52. Adjustment washer 50 has a knurled edge 54 for purposes of outer blade 25 adjustment.

Figure 17:
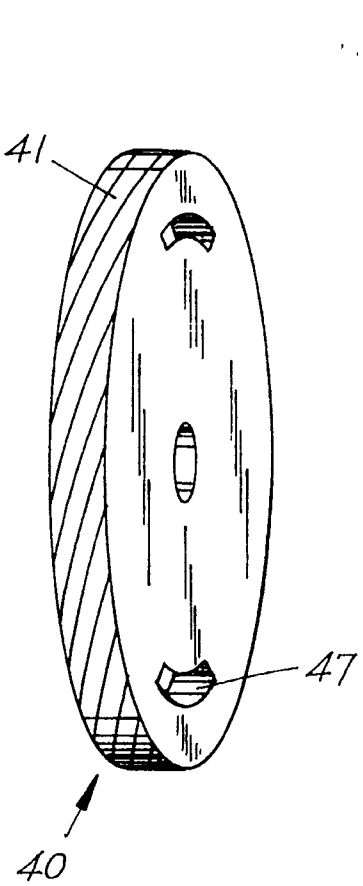
FIG. 17 is a perspective view of the fourth alternative embodiment of the adjusting collar.
Figure 16:
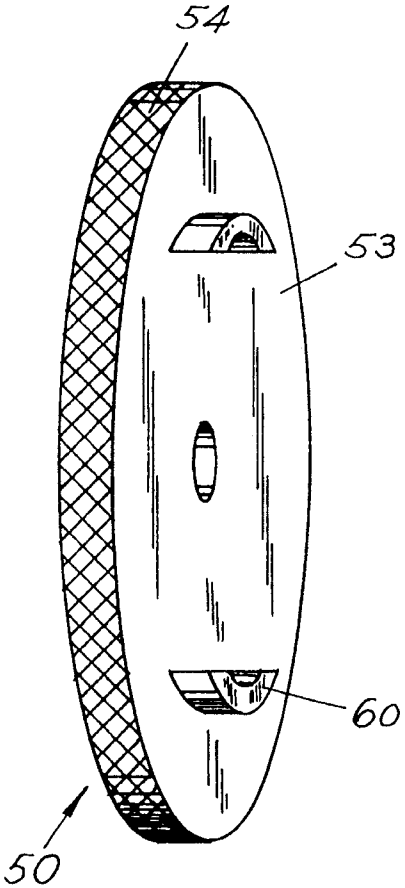
FIG. 16 is a perspective view of the fourth alternative embodiment of the adjustment washer.

The fourth alternative embodiment of the present invention is shown in FIGS. 16 and 17. As can be seen in FIG. 16, adjustment tabs 60 have been attached to adjustment washer 50. As shown in FIG. 17, receiving slots 47 are formed in adjusting collar 40. The tabs 60 and slots 47 operate in the same manner as the adjustment pins 51 and openings 42. As indicated in the other alternative embodiments, the location of the adjustment tabs 60 and slots 47 can be interchanged without affecting the function of the present invention.

Further, although performance will be affected in that the adjustment ability will be limited, the invention, as shown for example in FIGS. 16 and 17, may be modified to eliminate all offsets like circumferential annular ring 52, so that the contacting means for contacting the outer blade 25 is only the front face 53 of the adjustment washer 50. In this embodiment adjustment is limited by the thickness of the adjustment collar 40. While this design may be used it should be noted that full thread contact between the collar 40 and the outer blade 25 could be lost and could eventually adversely affect the performance of the machine.

In the preferred embodiment of adjustable dado 10, opening 27 is bored to 2 inches and inner threads 26 are threaded to 24 threads per inch. Adjusting collar 40 is turned out of 2 inch pre-hard steel stock and also threaded with outer threads 41 to 24 threads per inch. Adjustment washer 50 is turned from 3 inch pre-hard steel stock having a thickness of 0.23 inches. To aid in the adjustment of adjusting collar 40 by turning adjustment washer 50, adjustment washer 50 preferably has a knurled edge 54. Inner threads 26 and outer threads 41 provide a 1/24 inch (0.0417 inch) travel per revolution. That gives the adjustable dado 10 a total available fine adjustment from 0–1/16 of an inch, in addition to the incremental 1/16 inch adjustment from the chippers 15.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An adjustable dado comprising:
an inner blade;
a plurality of chippers;
an outer blade with a bore having inner threads;
an adjusting collar having at least one opening and outer threads;
the outer threads engaging the inner threads;
an adjustment washer having a front surface, an outer circumference, at least one adjustment pin extending from the front surface, and a circumferential annular ring extending from the front surface;
the adjustment pin engaging the opening;
the circumferential annular ting contacting the outer blade.

2. The adjustable dado in claim 1, wherein the outer circumference of the adjustment washer is knurled.

3. The adjustable dado of claim 1 wherein the inner threads and the outer threads are threaded to 24 threads per inch.

4. An adjustable dado consisting essentially of:
an inner blade;
a plurality of chippers;
an outer blade with a bore having inner threads;
an adjusting collar having a plurality of openings and outer threads;
the outer threads engaging the inner threads;
an adjustment washer having a front surface, a knurled outer circumference, a plurality of adjustment pins extending perpendicularly from the front surface, and a circumferential annular ring extending perpendicularly from the front surface;
the adjustment pins engaging the openings;
the circumferential angular ring contacting the outer blade.

5. An adjustable dado comprising:
an inner blade;
a plurality of chippers;
an outer blade with a bore having inner threads of 24 threads per inch;
an adjustment collar turned out of two inch pre-hard steel, having at least one opening and outer threads of 24 threads per inch;
the outer threads engaging the inner threads;
an adjustment washer turned out of three inch pre-hard steel, having a front surface, an outer knurled circumference, at least one adjustment pin extending perpendicularly from the front surface, and a circumferential annular ring extending perpendicularly from the front surface;
the adjustment pin engaging the opening and
the inner threads and the outer threads having a total travel of least 1/24 inch per revolution.

6. An adjustable dado comprising:
an inner blade;
a chipping means for chipping wood;
an outer blade with a bore;
an adjusting collar having a first connecting means and an outer surface;
the outer surface threadedly engaging the bore;
an adjustment washer having an outer circumference, a second connecting means for engaging with the first connecting means, and a contacting means for contacting the outer blade;
the first connecting means engaging the second connecting means;
the contacting means contacting the outer blade.

7. The adjustable dado in claim 6, wherein the chipping means comprise a plurality of chippers.

8. The adjustable dado in claim 6, wherein the first connecting means comprises at least one opening and the second connecting means comprises at least one adjustment pin.

9. The adjustable dado in claim 6, wherein the first connecting means comprises at least one adjustment pin and the second connecting means comprises at least one opening.

10. The adjustable dado in claim 6, wherein the first connecting means comprises at least one slot and the second connecting means comprises at least one adjustment tab.

11. The adjustment dado of claim 6, wherein the first connecting means comprises at least one adjustment tab and the second connecting means comprises at least one slot.

12. The adjustable dado of claim 6, wherein the outer circumference of the adjustment washer is knurled.

13. The adjustable dado of claim 6, wherein the outer surface threadedly engages the bore at 24 threads per inch.

14. The adjustable dado of claim 6, wherein the contacting means comprise a circumferential annular ring.

15. The adjustable dado of claim 6, wherein the contacting means comprise a plurality of legs.

16. The adjustable dado of claim 6, wherein the contacting means comprise the front surface of the adjustment washer.

17. An adjustable dado comprising:
an inner blade;
chipping means for chipping wood;
an outer blade with a bore having inner threads;
an adjusting collar having a first connecting means and outer threads;
the outer threads engaging the inner threads;
an adjustment washer having a front surface, a second connecting means attached to the front surface, and a flange extending from the front surface;
the first connecting means engaging the second connecting means;
the flange contacting the outer blade.

18. An adjustable dado comprising:
an inner blade;

chipping means for chipping wood;

an outer blade with a bore having inner threads;

an adjusting collar having a first connecting means and outer threads;

the outer threads engaging the inner threads;

an adjustment washer having a front surface, an outer circumference, a second connecting means attached to the front surface, and a contacting means for contacting the outer blade extending from the front surface;

the first connecting means engaging the second connecting means;

the contacting means contacting the outer blade.

* * * * *

UNITED STATES PATENT AND TRADEMARK OFFICE

CERTIFICATE OF CORRECTION

PATENT NO. : 5,368,079

DATED : 29 November 1994

INVENTOR(S) : Randy E. Benway

It is certified that error appears in the above-indentified patent and that said Letters Patent is hereby corrected as shown below:

In claim 1, column 5, line 38, delete "ting"

and insert --ring--.

Signed and Sealed this

Twenty-eight Day of March, 1995

*Attest:*

Bruce Lehman

BRUCE LEHMAN

*Attesting Officer*

*Commissioner of Patents and Trademarks*